US008439237B2

(12) United States Patent
Choi

(10) Patent No.: US 8,439,237 B2
(45) Date of Patent: May 14, 2013

(54) WIG OR HAIR PIECE BOX AND FORM

(75) Inventor: Kyung Ja Kay Choi, Great Neck, NY (US)

(73) Assignee: Sun Taiyang Co., Ltd., Moonachie, NJ (US)

( * ) Notice: Subject to any disclaimer, the term of this patent is extended or adjusted under 35 U.S.C. 154(b) by 1394 days.

(21) Appl. No.: 12/154,037

(22) Filed: May 20, 2008

(65) Prior Publication Data

US 2009/0289088 A1 Nov. 26, 2009

(51) Int. Cl.
*A42C 1/00* (2006.01)

(52) U.S. Cl.
USPC ..... 223/24; 223/84

(58) Field of Classification Search ..... 223/24, 223/25, 84; 206/8, 9, 278
See application file for complete search history.

(56) References Cited

U.S. PATENT DOCUMENTS

| | | | | | |
|---|---|---|---|---|---|
| 289,957 | A | | 12/1883 | Baxter | |
| 400,354 | A | * | 3/1889 | Morris | 473/564 |
| 1,224,427 | A | | 5/1917 | Stevens | |
| 1,984,371 | A | | 12/1934 | Hazard et al. | |
| 2,090,458 | A | * | 8/1937 | Nattenheimer | 223/24 |
| 2,298,602 | A | | 10/1942 | Varon | |
| 3,188,752 | A | * | 6/1965 | Skinner | 34/104 |
| 3,289,823 | A | | 12/1966 | Weiser et al. | |
| 3,310,267 | A | * | 3/1967 | Koehler | 248/176.1 |
| 3,312,439 | A | | 4/1967 | Swee et al. | |
| 3,327,842 | A | | 6/1967 | Meredith et al. | |
| 3,338,388 | A | | 8/1967 | Igoe et al. | |
| D209,952 | S | | 1/1968 | Lint | |
| 3,392,737 | A | | 7/1968 | Fefferman | |
| 3,438,480 | A | | 4/1969 | Chabrelot | |
| D214,242 | S | | 5/1969 | Klugmann | |
| 3,465,926 | A | * | 9/1969 | Schwartz et al. | 223/67 |
| D215,902 | S | | 11/1969 | Cohen | |
| 3,501,072 | A | * | 3/1970 | Kovener | 223/66 |
| D220,230 | S | | 3/1971 | Friedman | |
| 3,587,836 | A | * | 6/1971 | Brown | 206/8 |
| 3,603,489 | A | * | 9/1971 | Fleisher | 223/66 |
| 3,621,988 | A | | 11/1971 | Songer et al. | |
| 3,626,955 | A | | 12/1971 | Greenwood | |
| 3,658,174 | A | * | 4/1972 | Friedman | 206/8 |
| 3,659,704 | A | | 5/1972 | Collura et al. | |

(Continued)

FOREIGN PATENT DOCUMENTS

FR 2723067 A1 2/1996

OTHER PUBLICATIONS

X-Pression, <retrieved on Jul. 29, 2009 from: http://img.alibaba.com/photo/104772179/Ultra_Braid_X_Pression_Hair_Extension.jpg>.

*Primary Examiner* — Shelley Self
*Assistant Examiner* — Andrew Sutton
(74) *Attorney, Agent, or Firm* — Venable LLP; Frank M. Gasparo

(57) ABSTRACT

An exemplary embodiment providing one or more improvements includes wig or hair piece boxes for both the efficient storage and display of wigs or hair pieces before sell, as well as providing simple, efficient and effective storage facilities for wigs or hair pieces for use of the consumer. The wig or hair piece boxes include a form which holds the wig or hair piece and preserves the curl, style, and one directional curl of the hair tip end on the wig or hair piece. This avoids the common problem of loss of original curl and style of the wig or hair piece which plagues conventional wig and hair piece boxes.

26 Claims, 11 Drawing Sheets

U.S. PATENT DOCUMENTS 3,746,293 A 7/1973 Silvia
3,750,869 A * 8/1973 Kartiganer ..... 206/756
3,754,662 A * 8/1973 Prinz ..... 211/13.1
3,770,114 A 11/1973 Jackson
3,777,951 A 12/1973 Newsteder
3,779,433 A 12/1973 Imai
3,843,031 A 10/1974 Oh et al.
3,870,221 A 3/1975 Zeitter
3,891,082 A 6/1975 Fall
3,917,158 A 11/1975 Dorofachuk et al.
3,934,804 A 1/1976 Bruce
4,016,889 A 4/1977 Cowles
4,032,005 A 6/1977 Vereb
4,258,842 A * 3/1981 Falkstein ..... 206/8
4,422,230 A 12/1983 Nemoto
4,998,992 A * 3/1991 Richlin et al. ..... 223/66
D318,174 S 7/1991 Hanson
5,069,334 A 12/1991 Herrin et al.
5,234,370 A 8/1993 Shapero et al.
5,348,148 A 9/1994 Lancaster
5,380,002 A * 1/1995 Spector ..... 473/519
5,595,199 A 1/1997 Solomon et al.
6,598,746 B2 7/2003 Lux, Jr. et al.
6,830,054 B1 12/2004 Ross-Kuehn
7,201,171 B2 4/2007 Sthair
2003/0159962 A1 8/2003 Heo
2004/0220000 A1 * 11/2004 Falone et al. ..... 473/568

* cited by examiner

WIG OR HAIR PIECE BOX AND FORM

CROSS-REFERENCES TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

REFERENCE TO A "SEQUENCE LISTING," A TABLE, OR A COMPUTER PROGRAM LISTING APPENDIX

Not Applicable.

BACKGROUND

Embodiments include containers and forms for preserving, storing, and displaying wigs and hair pieces.

BACKGROUND

Description of Related Art Including Information Disclosed Under 37 CFR 1.97 and 37 CFR 1.98

U.S. Pat. No. 3,289,823 discloses a wig container with a hinged support for a display head.

U.S. Pat. No. 3,327,842 discloses a wig box and styling stand with a collapsible styling stand.

U.S. Pat. No. 3,338,388 discloses a collapsible wig case which accommodates a upright head form with wig and is compact for storage when in the collapsed position.

U.S. Pat. No. 3,438,480 discloses a wig carrying case which supports a shaped manikin head in a convenient position for dressing a wig.

U.S. Pat. No. 3,587,836 discloses a prestyled wig carrier constructed primarily of a single piece which supports a styrofoam head with styled wig.

U.S. Pat. No. 3,621,988 discloses a rectangular case which contains one or more shaped manikin heads attached to the walls of the case.

U.S. Pat. No. 3,658,174 discloses a wig form support which fits securely in a rectangular case.

U.S. Pat. No. 3,770,114 discloses convertible case which accommodates a wig form in the horizontal position for transport.

U.S. Pat. No. 3,891,082 discloses an inflatable wig tote with inflatable wig form.

U.S. Pat. No. D209,952, a design patent, discloses the ornamental design for a doll wig package.

U.S. Pat. No. D318,174, a design patent, discloses the ornamental design for a box for containing a cap.

None of the prior art wig or hair piece boxes deal with the problem of loss of style and curl or deals with the preservation of one directional curl and style of stored wigs and hair pieces. Embodiments of the present disclosure solve this long-recognized problem.

The foregoing examples of the related art and limitations related therewith are intended to be illustrative and not exclusive. Other limitations of the related art will become apparent to those of skill in the art upon a reading of the specification and a study of the drawings.

Embodiments of the present disclosure meet the need for a compact wig and hair piece box which allows efficient transport, storage and display of the contained wig or hair piece before it is sold to a consumer, and thereafter allows convenient compact storage of the wig or hair piece by the consumer.

BRIEF SUMMARY

Embodiments include a wig or hair piece box comprising: a rectangular enclosure having a bottom wall, two side walls, two end walls, and a hinged front wall. The bottom, front, and side walls having the same length. The bottom and front walls having a greater width than the side walls. One side wall having a slit, the front wall having a window, a flap hinged to the front wall, the flap having a tab for insertion into the side wall slot, and an upper spacer at one end wall and a lower spacer at the other end wall.

Other embodiments include a wig or hair piece form for holding a wig or hair piece which comprises a body having a top end and a lower end, a shoulder attached to the top end and extending around the edges of the top end, the top end and the body oval in cross section with a major axis and a minor axis, the major and minor axes throughout the body parallel and gradually increasing from the top end to the lower end, and the lower end having a hemi-ovoid shape.

Embodiments include a wig and hair piece box with a form which holds the wig or hair piece and preserves the original style and one directional tip end curl.

In addition to the exemplary aspects and embodiments described above, further aspects and embodiments will become apparent by reference to the drawings and by study of the following descriptions.

DETAILED DESCRIPTION

The following embodiments and aspects thereof are described and illustrated in conjunction with systems, tool and methods which are meant to be exemplary and illustrative, not limiting in scope. In various embodiments, one or more of the above-described problems have been reduced or eliminated, while other embodiments are directed to other improvements.

In this disclosure the term "wig" means an easily detachable manufactured covering of natural or synthetic hair for the head. The term "hair piece" means natural or synthetic hair which is either woven to a user's natural hair for long term use or detachable attachment for short term use, commonly termed a weave or extension. The term "weft" means a collection of multiple strands of natural or synthetic hair (attached together by intricate stitched work with a sewing machine or fused together by glue and woven material) which is treated as a unit in the manufacture and styling (making) of a wig or hair piece. The term "weft track" means a strip (stitched or fused section) to which wefts (strands) of hair are attached. The term "root end" means the end of hair which is stitched or fused together to the weft track, which is to be attached to the wig supporting fabric or base cap, or to the user's natural hair in the case of a hair piece. The term "tip end" means the opposite ends of the strands of hair or weft which is not attached to the wig or hair piece supporting fabric or base cap or to user's natural hair.

Figure 1:
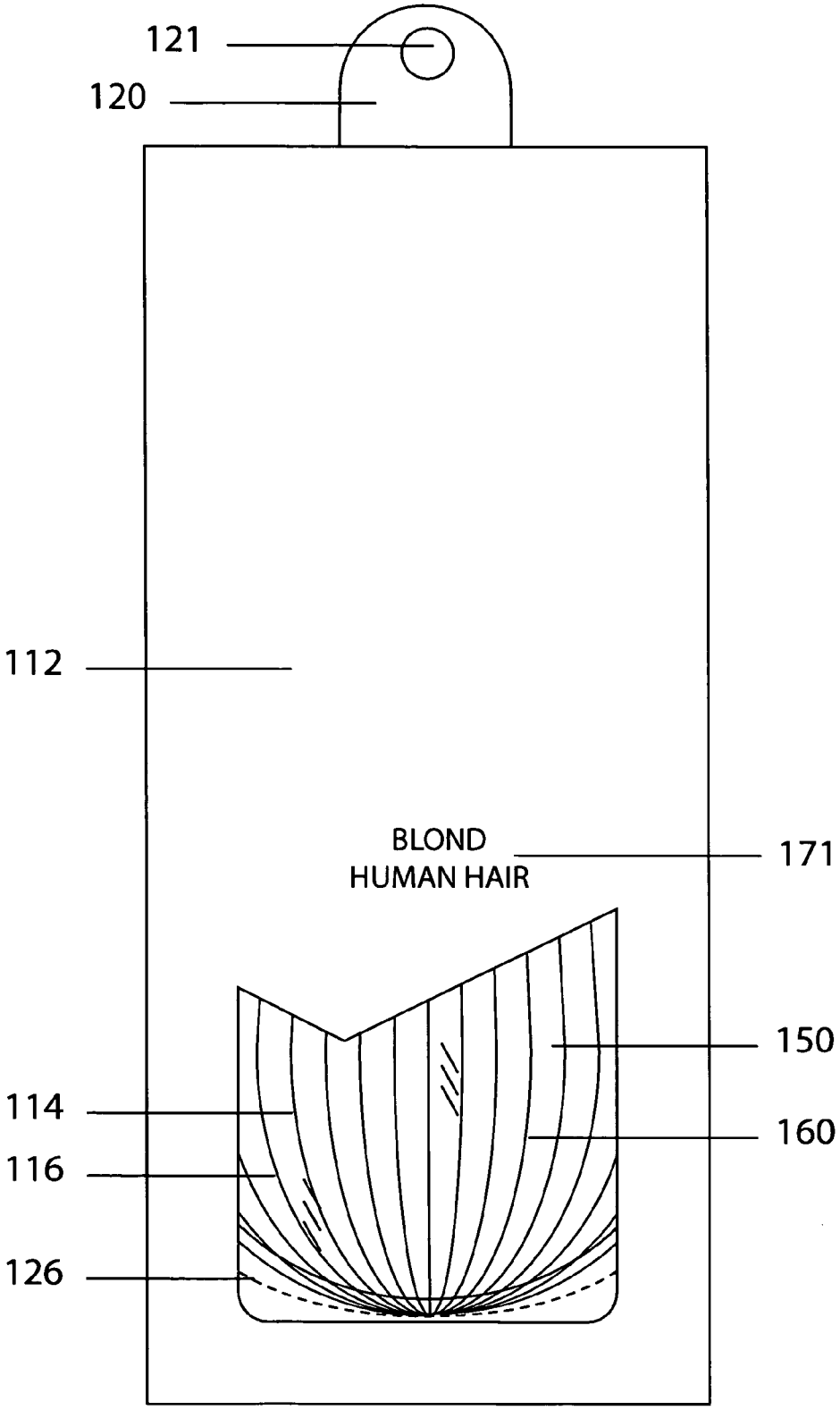
FIG. 1 is a front view of an embodiment closed wig or hair piece box 100 containing a wig or hair piece on a form.

FIG. 1 is a front view of an embodiment closed wig or hair piece box containing a wig or hairpiece on a form. Visible in FIG. 1 is the hanger 120 with hole 121, front wall 112, window 114 with transparent pane 116, and enclosed form 150 with attached wig or hair piece 160. Retainer 126 is also visible in FIG. 1. Descriptive indicia 171 may be located on the box.

Figure 2:
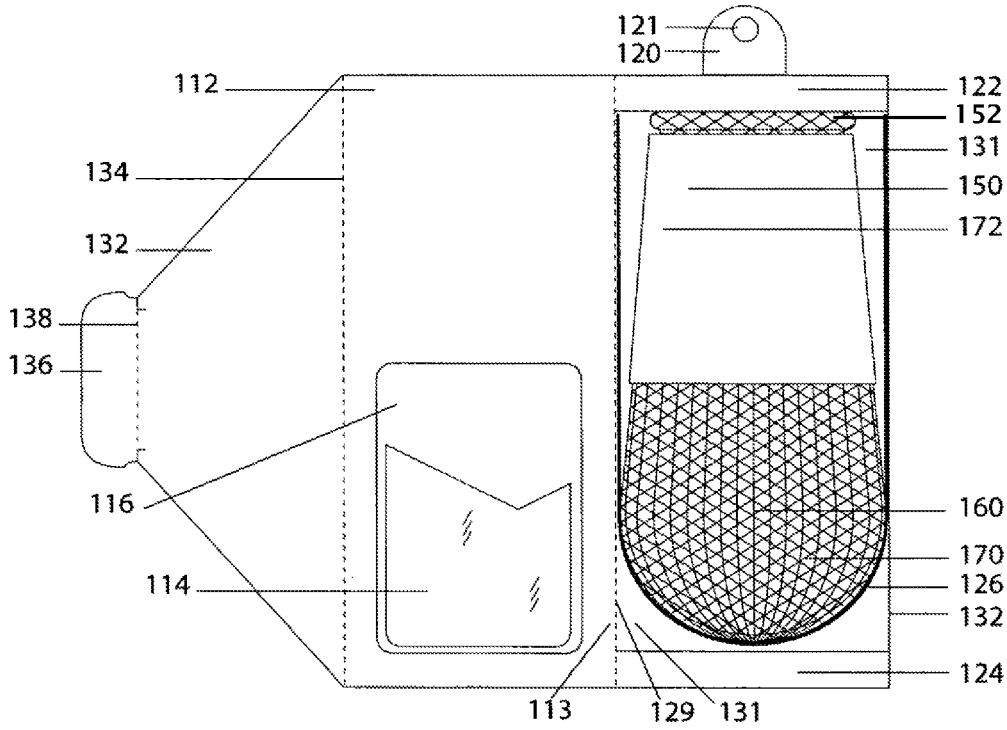
FIG. 2 is a view of an embodiment wig or hair piece box containing a wig or hair piece on a form with the front wall opened.

FIG. 2 is a view of an embodiment wig or hair piece box containing a wig or hair piece on a form with the front wall opened. Visible in FIG. 2 is the form 150 with form top 152 having an attached wig or hair piece 160, hairnet 170, and sleeve 172. The form was placed in an enclosure comprised of bottom wall 131, left wall 129, right wall 132, upper spacer 122, and lower spacer 124. Hanger 120 with a hole 121 extended from the upper spacer 122. A U-shaped retainer 126 secured the form in the enclosure. The front wall 112 was attached at fold 113 to left wall 129. A window 114 in front wall 112 was covered by transparent pane 116. A flap 132 was attached at fold 134 to front wall 112. A tab 136 was attached to flap 132 at fold 138.

Figure 3:
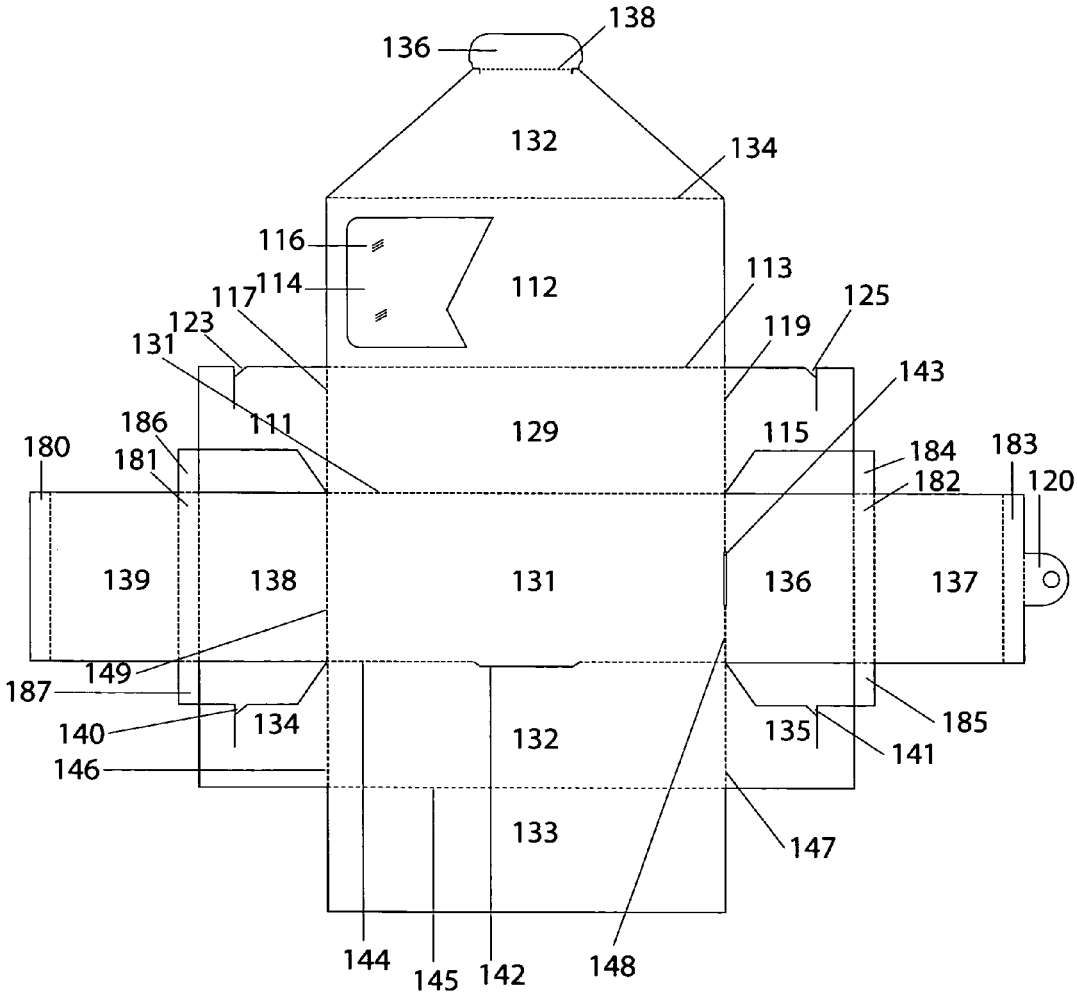
FIG. 3 is a view of the inside of an embodiment wig or hair piece box before the box is folded.

FIG. 3 is a view of the inside of an embodiment wig or hair piece box before the box is folded and assembled. The box is constructed from a single piece of material, with the exception of the transparent window pane. Fold lines are indicated by dashed lines. Visible in FIG. 3 is the bottom wall 131, the top wall 112, the left side wall 129, and the right side wall 132. The right side wall 132 has a flap 133 which is folded up on fold line 145 and adhesively attached to the right side wall 132. The bottom wall, top wall and left and right side walls have the same length. The widths of the bottom wall and top wall are equal and greater that the widths of the side walls. A slit 142 is at the junction between the bottom wall 131 and the right side wall 132. The top wall 112 has a window 114 which is covered by a transparent pane 116. A flap 132 is attached to the front wall 112. A tab 136 is attached to the flap 132.

Left upper assembly tab 115 and left lower assembly tab 111 are attached to left wall 129. Right upper assembly tab 135 and right lower assembly tab 134 are attached to right wall 132. V-shaped notches and cuts 125, 123, 141, and 140 are cut into the assembly tabs 115, 111, 135 and 134, respectively.

An upper spacer is comprised of an upper end wall 136, upper wedge 182, upper flap 137, and flange 183 and is attached to one end of the bottom wall 131. A slit 143 is cut between the upper end wall 136 and the bottom wall 131. A lower spacer is comprised of a lower end wall 138, lower wedge 181, lower flap 138 lower flange 180 and is attached to the other end of the bottom wall 131. Upper wedge 182 has flaps 184 and 185 attached at the edges of the wedge. Lower wedge 181 has flaps 186 and 187 attached at the edges of the wedge.

The first step in assembling the box was to fold the flap 133 at fold 145 through about 180° until it was flat against right side wall 132. Flap 133 was adhesively fixed to the right side wall 132.

Assembly tabs 115 and 111 were bent upward along fold lines 125 and 117, respectively, at about right angles to left side wall 129. Assembly tabs 135 and 134 were bent upward along fold lines 147 and 146, respectively, at about right angles to right side wall 132.

Left side wall 129 was bent upward at fold 131 at about a right angle to bottom wall 131. Right side wall 132 was bend upward at fold 144 at about a right angle to bottom wall 131.

V-shaped notches and cuts 123 and 134 of assembly tabs 111 and 134, respectively, were engaged to connect assembly tab 111 with assembly tab 134. V-shaped notches and cuts 125 and 141 of assembly tabs 115 and 135, respectively, were engaged to connect assembly tab 115 with assembly tab 135.

Upper end wall 136 was bent upward at fold 148 at about a right angle to bottom wall 131. Tabs 184 and 185 were bend upward at about a right angle to upper wedge 182. Upper wedge 182 and upper flap 137 were bent against tabs 184 and 185 so that the tabs were enclosed by upper end wall 136 and upper flap 137. In addition, the interlocked upper assembly tabs 115 and 135 were enclosed between upper end wall 136 and upper flap 137. Finally, flange 183 was bent at about a right angle to upper flap 137 and hanger 120 was inserted through slit 143. Flange 183 was adhesively secured to bottom wall 131.

Lower end wall 138 was bent upward at fold 149 at about a right angle to bottom wall 131. Tabs 186 and 187 were bend upward at about a right angle to lower wedge 181. Lower wedge 181 and lower flap 139 were bent against tabs 181 and 187 so that the tabs were enclosed by lower end wall 138 and lower flap 139. In addition, the interlocked lower assembly tabs 111 and 134 were enclosed between lower end wall 138 and lower flap 139. Finally, flange 180 was bent at about a right angle to lower flap 139. Flange 180 was adhesively secured to bottom wall 131.

The above foldings and securings resulted in a rectangular enclosure with bottom wall 131, left side wall 129, right side wall 132, upper spacer 122 (shown on FIG. 2) and lower spacer 124 (shown on FIG. 2). At this point a form with an attached wig or hair piece was inserted in the rectangular enclosure. Front wall 112 was bent at fold 113 at about a right angle to cover the open top of the rectangular enclosure with inserted form with a wig and flap 132 was bent at fold 134 at about right angles to extend over the outside of right wall 132. Flap 132 was secured by insertion of tab 136 into slit 142, providing a wig box which can be reversible closed and secured.

Embodiments of wig or hair piece boxes were manufactured by any suitable thin, flexible, durable material, such as cardboard or plastic strips. The transparent pane was manufactured any suitable transparent material such as plastic, glass, or cellophane. It is anticipated that the outer surfaces of the boxes will have indicia relating to the box contents. Embodiments include wig or hair piece boxes with front wall 7 inches in length, 4 inches in width, and with side walls 3 inches in height.

Figure 4:
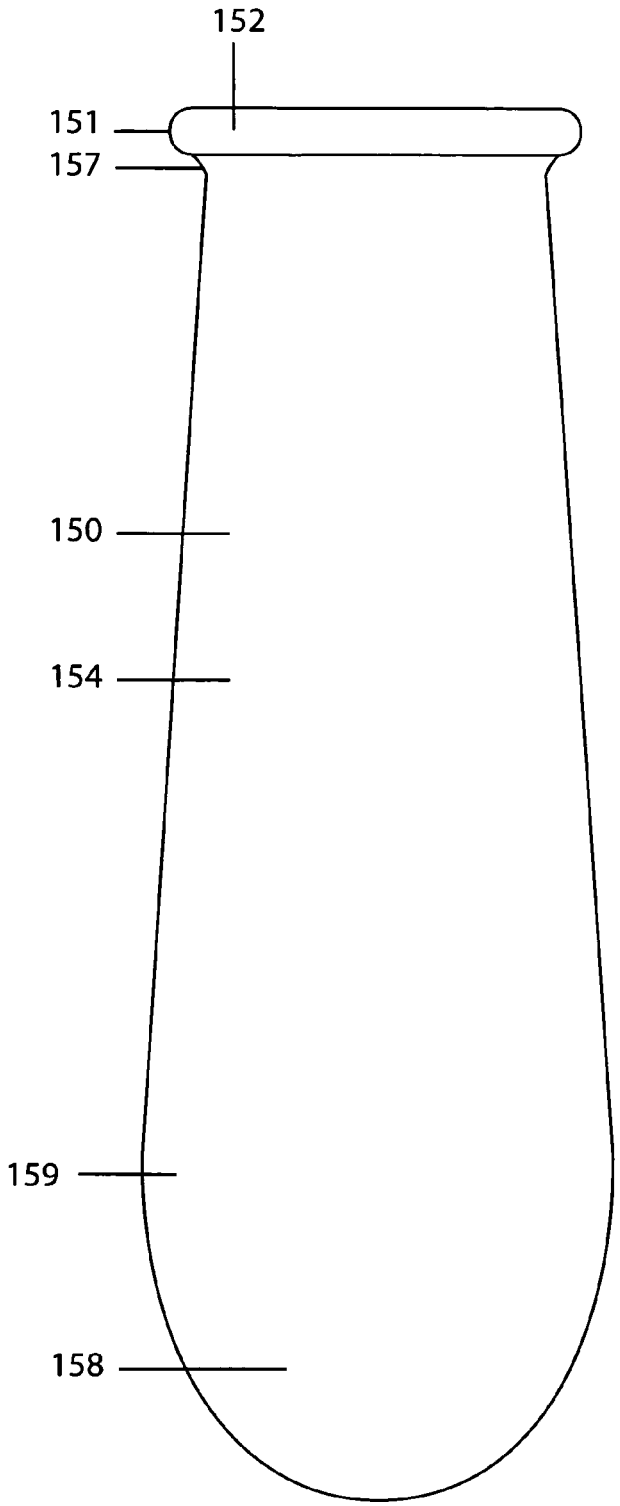
FIG. 4 is side view of an embodiment form.

FIG. 4 is side view of an embodiment form 150 which comprises a form top 152 and a form body 154. The form body 154 has an upper end 157, a lower end 159, and the bottom 158 of the body. The top 152 has a shoulder 151 which extends about the circumference of the top. The body 154 has the shape of an oval which gradually increases in both major and minor axes to the lower end 159 of the body. A major axis is longer than a minor axis. The bottom 158 of the body has a hemi-ovoid shape, that is, approximating the shape of an egg which has been sliced along its length. In FIG. 4 the minor axes of the body is approximately parallel to the surface of the figure.

Embodiment forms have the major axis equal to the minor axis, that is, are cylindrical in shape with any cross section taken along the length of the form having the shape of a circle. Such embodiments have a bottom of the body with a hemispheric shape.

Embodiment forms are manufactured of any suitable strong, resilient material. Suitable materials include foamed plastics, some examples of which are polystyrene, polybutadiene, polyurethane, and polyethylene. Other embodiments include forms manufactured of cardboard or papier-mache. Other embodiment forms are manufactured of flexible plastic or rubber, are bag-like in structure, and are filled with a fluid such as air or water.

Embodiment forms have a top with minor axis of 2¼ inches and major axis of 3¼ inches. Embodiments have a body length of 7 inches. It is specifically contemplated that the dimensions of embodiments will vary according to the dimensions of the wigs used with the forms.

Figure 5:
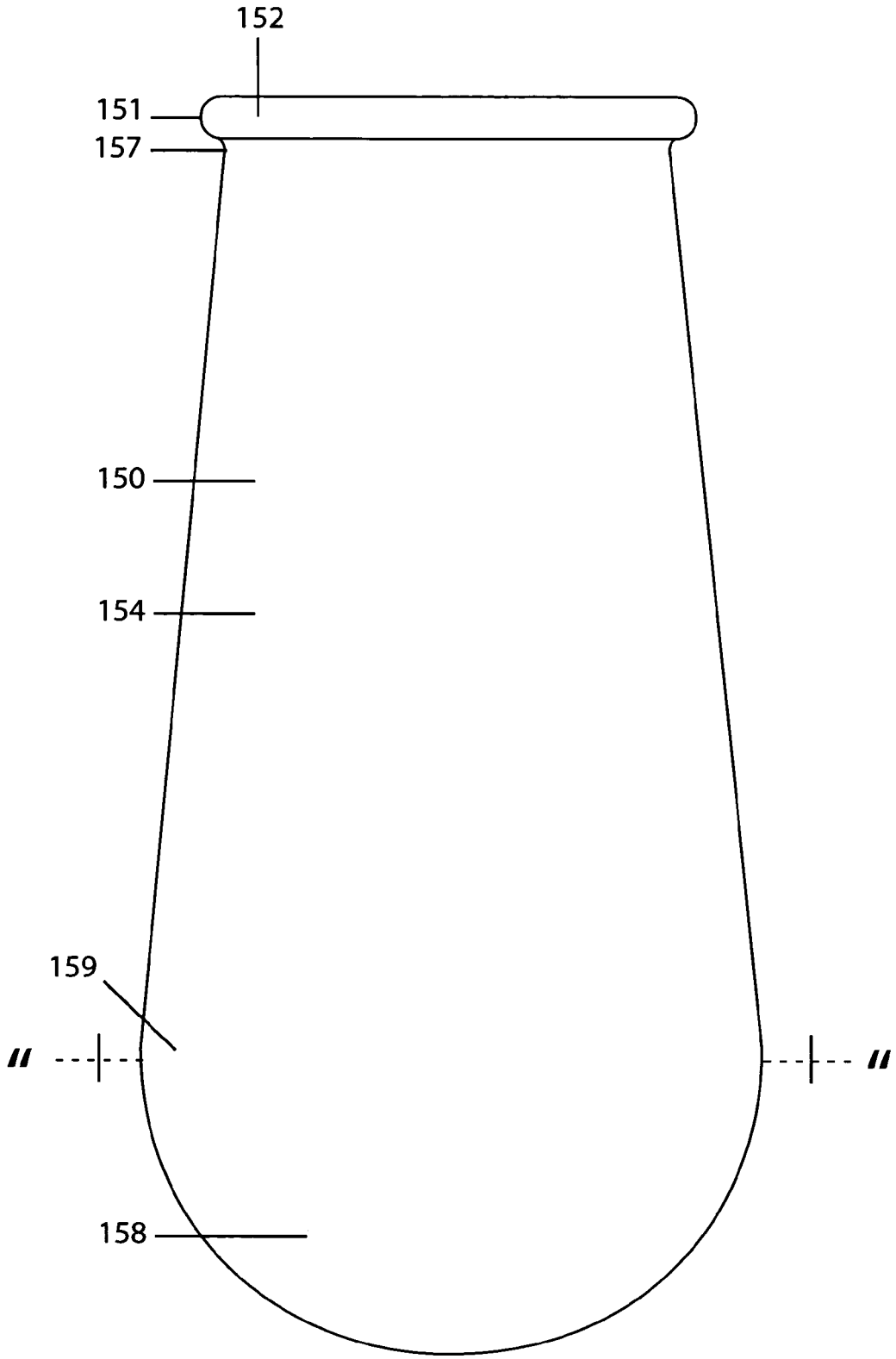
FIG. 5 is a front view of an embodiment form.

FIG. 5 is a front view of an embodiment form 150. The features and descriptions of FIG. 4 also apply to FIG. 5. In FIG. 5 the major axes of the body is approximately parallel to the surface of the figure.

Figure 6:
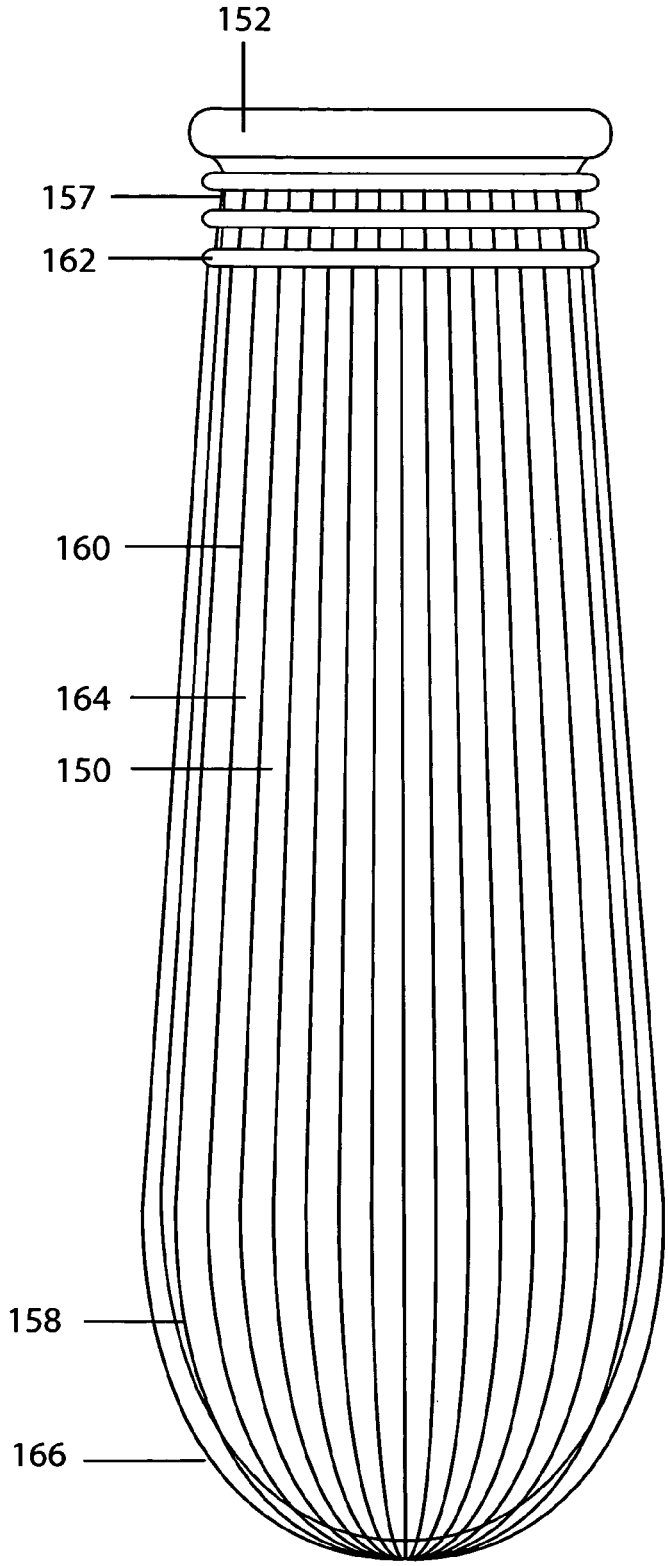
FIG. 6 is a side view of an embodiment form with wig or hair piece attached.

FIG. 6 is a side view of an embodiment form with wig attached. In FIG. 6 the minor axis of the top and form body is parallel to the surface of the figure. Visible in FIG. 6 is the form 150, the top 152 of the form, the upper end 157 of the form, and the form bottom 158. The top 152 has a shoulder which extends from the circumference of the top.

Also visible in FIG. 6 is a wig or hair piece 160. This wig comprises an elongated band or weft track 162. Weft strands of hair 164 are fixedly attached to the band or weft track. In embodiments the band is 10 to 12 feet in length. In embodiments wefts of hair consist of 10 to 50 strands of hair. In embodiments the length of hair is about 7 inches. In embodiments the terminal ends of the wefts, termed "tip end" are curled, with the curl of all hair strands substantially parallel to each other, termed a "one directional tip end curl". Although embodiment wigs and hair pieces have wefts of hair comprised of human hair, the use of wigs and hair pieces with wefts of hair comprised of synthetic hair or animal hair is specifically contemplated.

In use, in embodiments, a first end of the elongated band or weft track 162 is removably attached to the form 150 at the upper end 157 of the form using a pin. The elongated band or weft track with attached hair strands is wrapped about the form and the second end of the elongated band or weft track is attached to the form body with another pin. The hair strands 164 are arrayed substantially parallel to each other about the outside of the form body with the wefts overlapping each other and extending down the form with the curled ends 166 of the hair strands substantially curled around the bottom 158 of the form body, preserving the one directional tip end curl of the wig or hair piece.

Although embodiments of the form are described in this application in connection with a wig comprised of an elongated band or weft track with attached wefts, it is specifically contemplated that other types of wigs also can be used in connection with the disclosed wig boxes and forms.

Although embodiments of the form are described in this application in connection with a wig or hair piece, it is specifically contemplated that forms can be used to hold hair pieces with the associated preservation of the original style and one directional tip end curl.

Embodiments of the disclosed wig boxes and forms are used both for the packaging and display of wigs and hair pieces for sale by manufacturers, as well as for use by consumers to conveniently store and preserve the condition of wigs and hair pieces when not in use. Embodiment boxes and forms allow convenient storing and displaying wigs or hair pieces while requiring a minimal amount of space.

Figure 7:
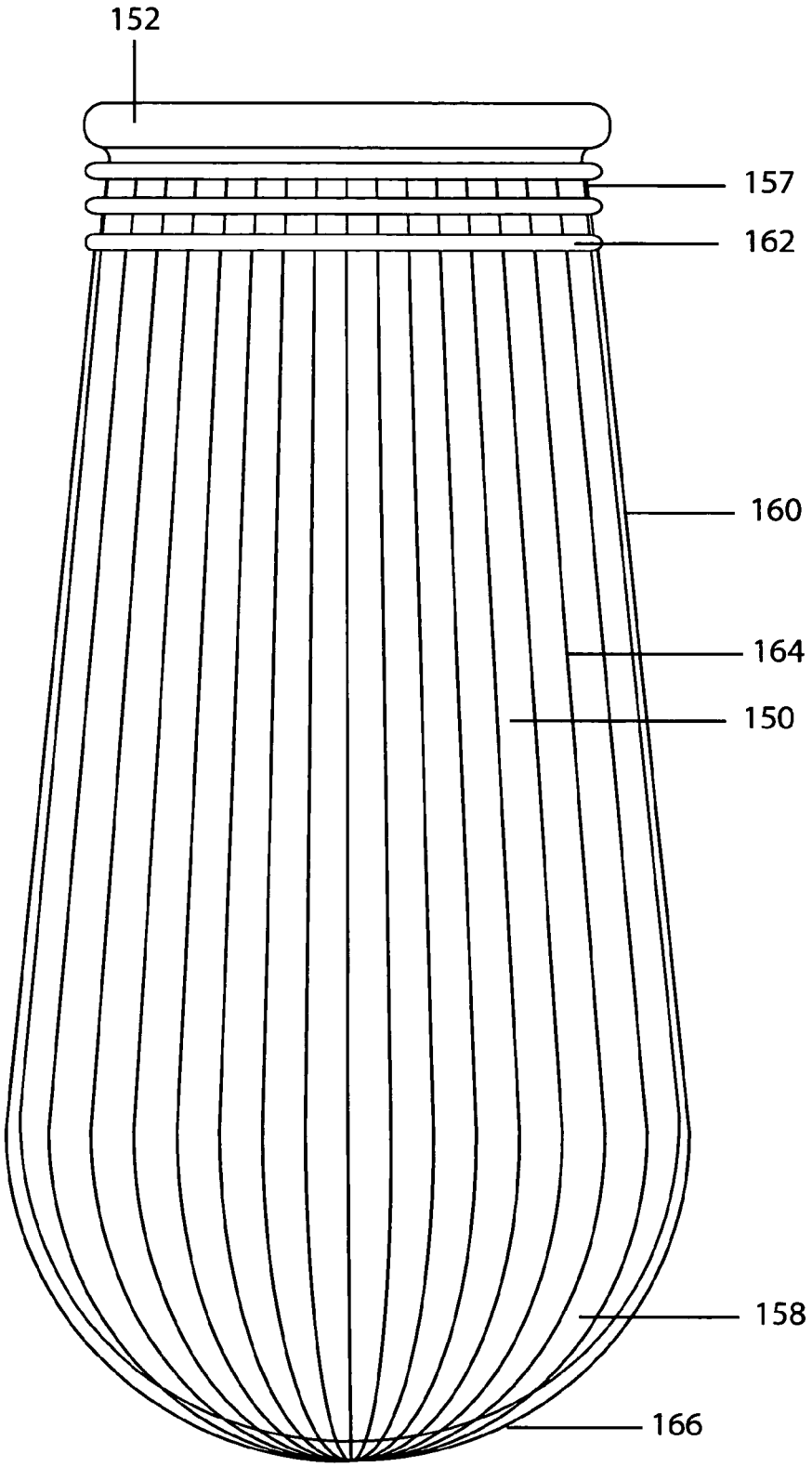
FIG. 7 is a front view of an embodiment form with wig or hair piece attached.

FIG. 7 is a front view of an embodiment form with wig or hair piece attached. In FIG. 7 the major axis of the top and form body is parallel to the surface of the figure. Visible in FIG. 7 is the form 150, the form top 152, the upper end 157 of the form, and the form bottom 158. Also visible in FIG. 7 is a wig 160 comprising an elongated band or weft track 162, wefts 164, and curls 166 at the end of the hair strands as described in connection with FIG. 6 with the one directional tip end curl preserved and with the tips of the strands of hair substantially covering the bottom of the form.

Figure 8:
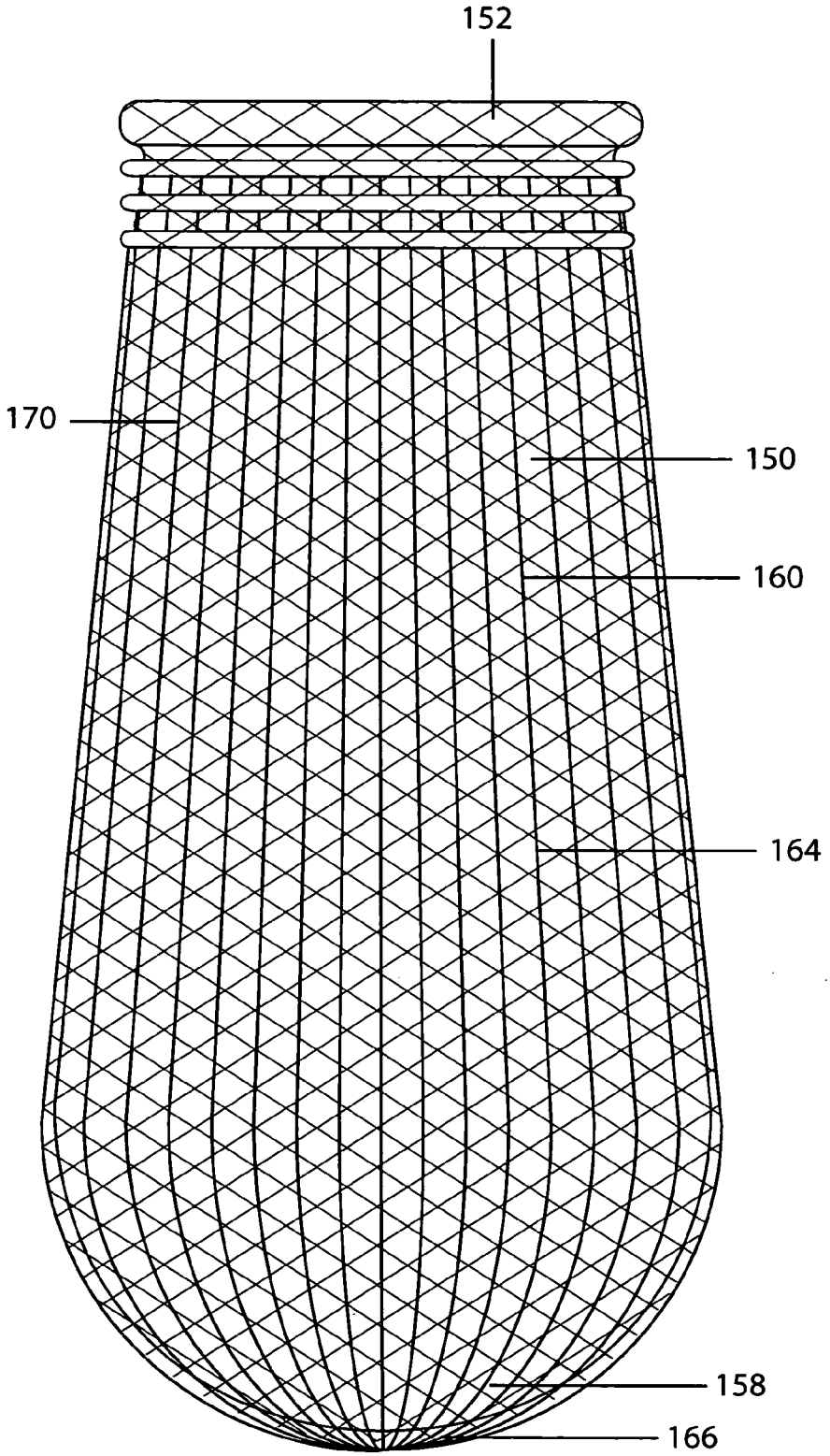
FIG. 8 is a front view of an embodiment form with wig or hair piece attached and covered by a hair net.

FIG. 8 is a front view of an embodiment form with wig or hair piece attached and covered by a hair net. Visible in FIG. 8 is the form 150, attached wig or hair piece 160, and hair net 170. The hair net is pulled over the form with attached wig or hair piece from the top 152 and serves to secure the wefts of hair 164 of the wig to the form, and helps to maintain the orientation of the wefts, and helps to maintain the one directional tip end curl 166 of the hair strands about the bottom 158 of the form 150 with the tips of the strands of hair 166 substantially covering the bottom 158 of the form 150.

Figure 9:
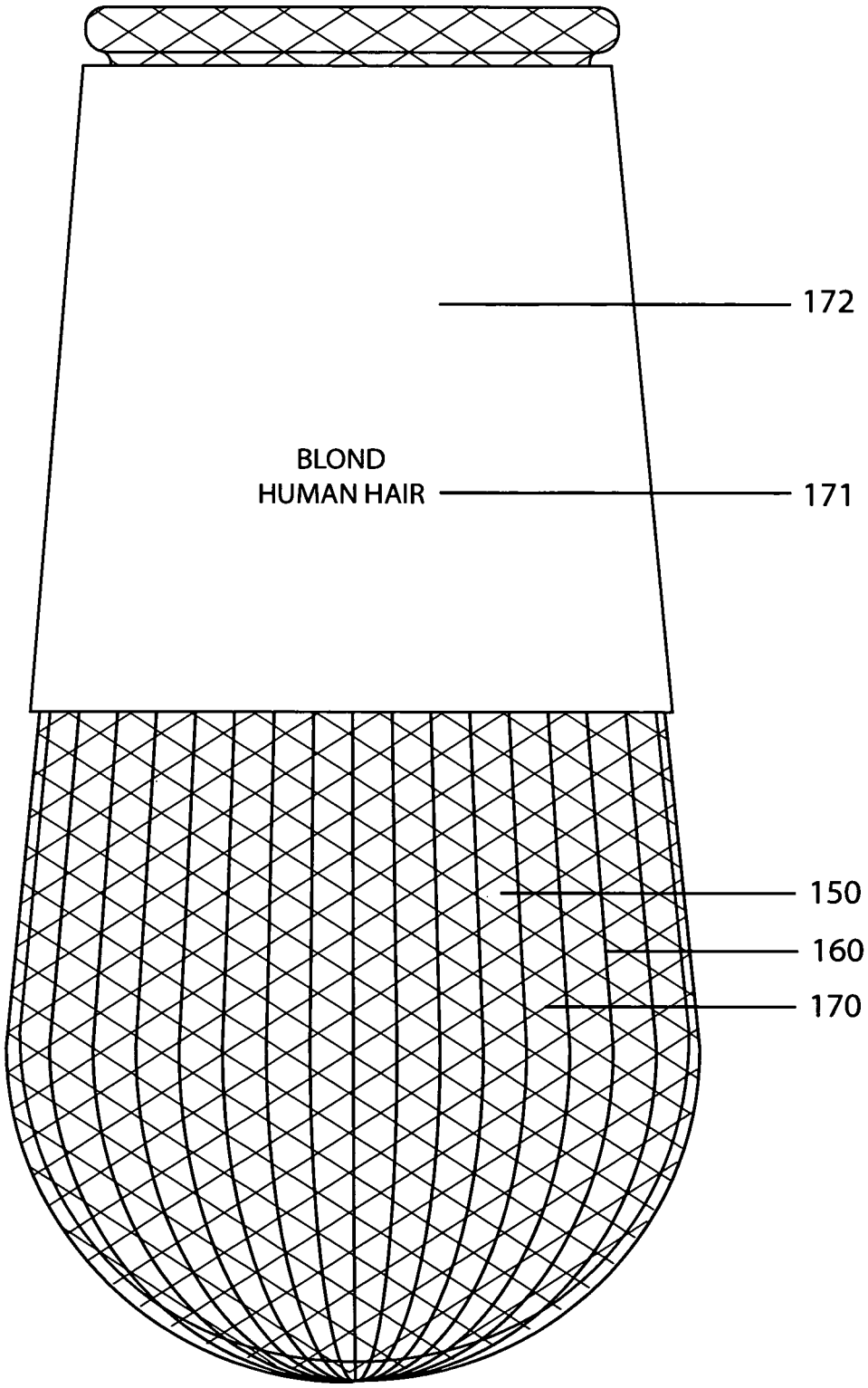
FIG. 9 is a front view of an embodiment form with wig or hair piece attached and covered by a hair net and by a sleeve.

FIG. 9 is a front view of an embodiment form with wig attached and covered by a hair net and by a sleeve. Visible in FIG. 9 is the form 150, the attached wig or hair piece 160, and a hair net 170 which has been pulled over the entire form with attached wig or hair piece, and a conical sleeve 172 which covers the hair net. The conical sleeve 172 may contain descriptive indicia 171 which identify the type of wig or hair piece.

Figure 10:
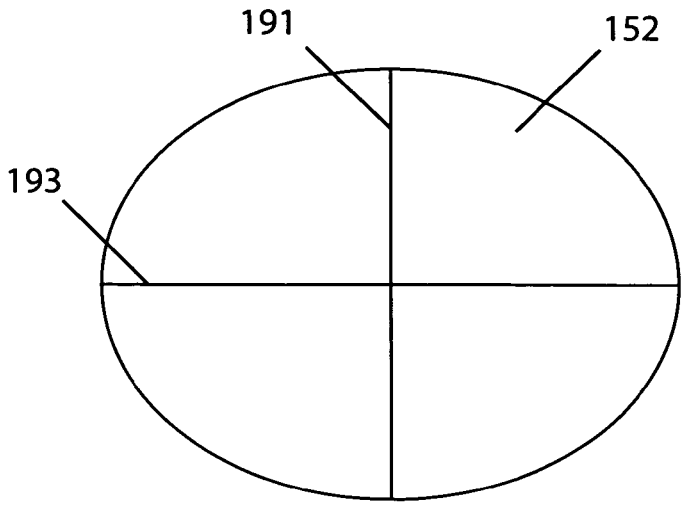
FIG. 10 is a top view of an embodiment form.

FIG. 10 is a view of the top of an embodiment form. The top 152 has the shape of an oval with a major axis 193 which is longer than the minor axis 191.

Figure 11:
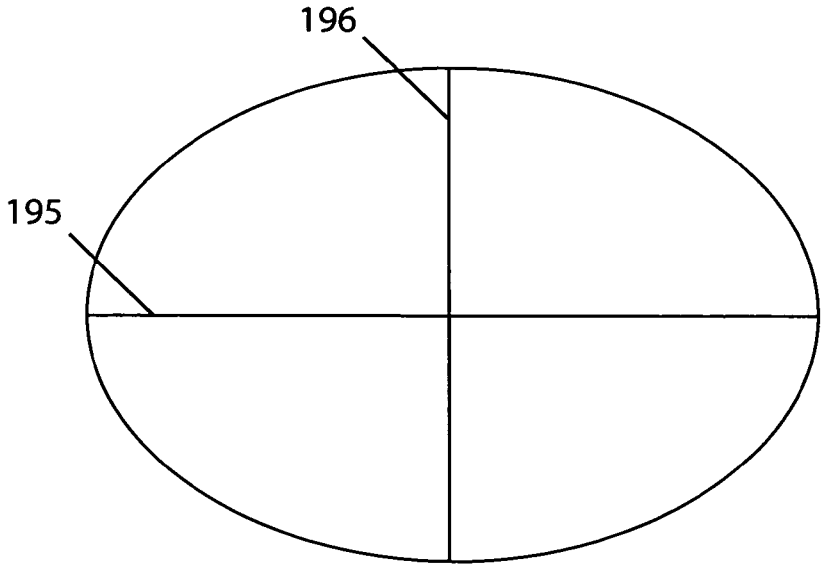
FIG. 11 is a cross section view of an embodiment form taken at line 11-11.

FIG. 11 is a cross section view of an embodiment form taken at line 11-11. The cross section of the form has the shape of an oval with a major axis 195 which is longer than the minor axis 196.

Figure 12:
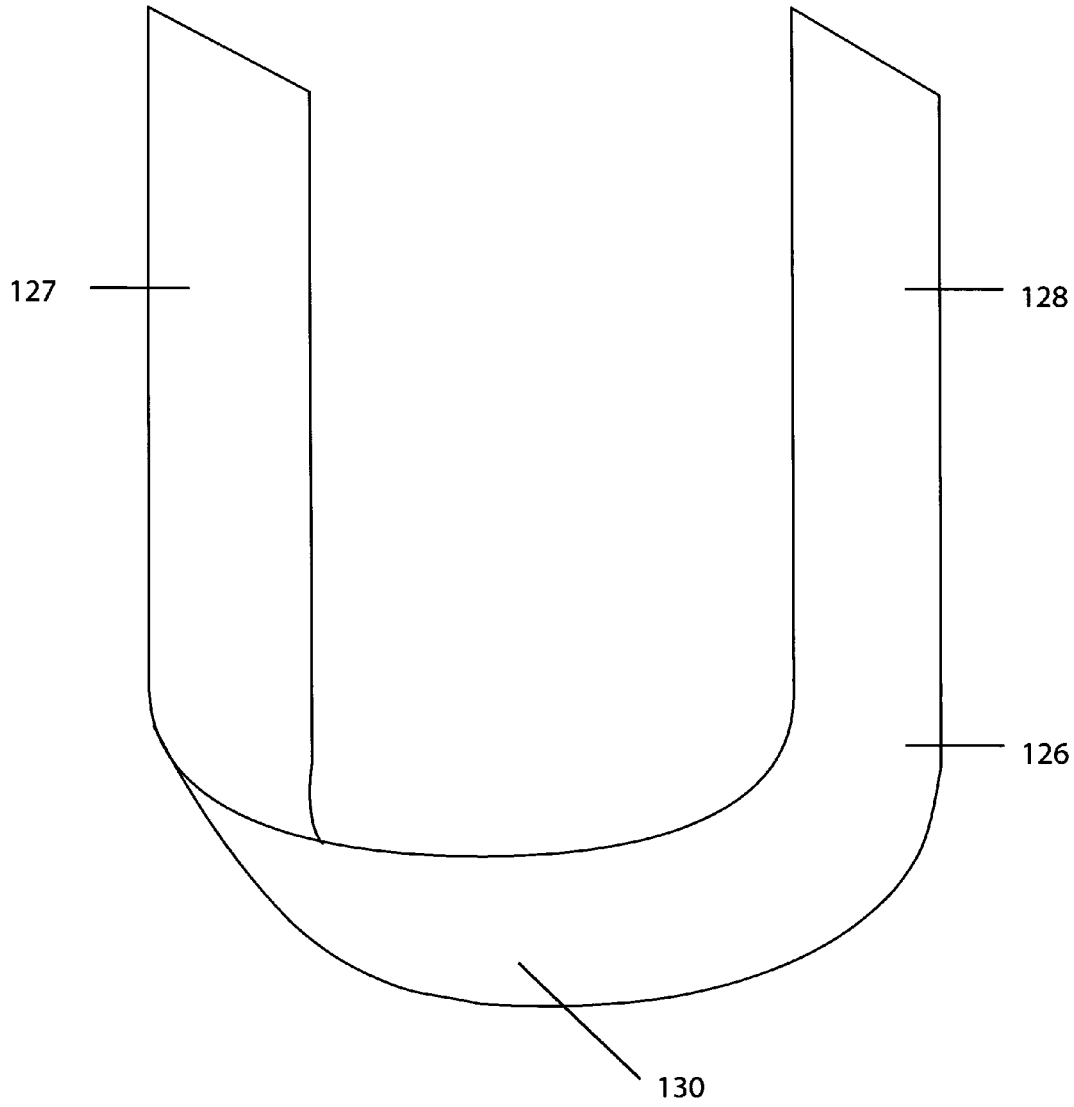
FIG. 12 is a perspective view of an embodiment U-shaped retainer.

FIG. 12 is a perspective view of an embodiment U-shaped retainer 126. Visible in FIG. 12 is the left arm 127, right arm 128, and retainer base 130. The retainer 126 prevents displacement of the form with attached wig or hair piece in the enclosure.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

I claim:

1. A combination comprising:

a form for holding a wig or hair piece comprising:

a body having a top end and a lower end, the body being oval or circular in cross section with a major axis and a minor axis, the major and minor axes throughout the body gradually increasing from the top end to the lower end, and the lower end having a curved shape; and a wig or hair piece comprising a weft track and strands of hair having a root end and a tip end, wherein the root ends are attached to the weft track, wherein the tip ends include a curl, wherein the weft track is removably attached to the form at the top end of the body and the strands of hair extend down the body toward the lower end of the body, and wherein the curls of the strands of hair extend over the lower end of the body.

2. The combination of claim 1, the form further comprising:

a shoulder attached to the top end and extending around the edges of the top end of the body.

3. The combination of claim 1, wherein the major axis is longer than the minor axis and the curved shape of the lower end is a hemi-ovoid shape.

4. The combination of claim 1, wherein the major axis is equal to the minor axis and the curved shape of the lower end is a hemisphere shape.

5. The combination of claim 1, wherein the body is manufactured of foamed plastic, polystyrene, polybutadiene, polyethylene, polyurethane, cardboard, or papier-mache.

6. The combination of claim 1, wherein the body is manufactured of flexible plastic or rubber and filled with air or water.

7. The combination of claim 1, the weft track having a first and a second end, the curls of substantially all of the strands of hair being substantially parallel to each other to define a one directional curl, the first end of the weft track removably attached to the form at the top end of the body, the weft track wrapped around the top end of the body, the second end of the weft track removably attached to the form at the top end of the body, the strands of hair substantially parallel to each other, substantially all curls at the tip ends of the strands of hair extending over the lower end of the body.

8. The combination of claim 1, further comprising:

a hair net covering the wig or hair piece on the form.

9. The combination of claim 1, further comprising:

a sleeve covering the wig or hair piece on the form.

10. A combination, comprising:

a form for holding a wig or hair piece comprising: a body having a top end and a lower end, the top end and the body being oval or circular in cross section with a major axis and a minor axis, the major and minor axes throughout the body gradually increasing from the top end to the lower end, and the lower end having a curved shape;

a wig or hair piece comprising a weft track and strands of hair having a root end and a tip end, wherein the root ends are attached to the weft track, wherein the tip ends include a curl, wherein the weft track is removably attached to the form at the top end of the body and the strands of hair extend down the body toward the lower end of the body, and wherein the curl of the strands of hair extend over the lower end of the body; and a wig or hair piece box comprising:

a rectangular enclosure having a bottom wall, two side walls, two end walls, and a hinged front wall, the bottom, front, and side walls of the same length, the bottom and front walls having a greater width than the side walls, one side wall having a slit the front wall having a window, a flap hinged to the front wall, the flap having a tab for insertion into the side wall slot, and an upper spacer at one end wall and a lower spacer at the other end wall, wherein the wig or hair piece form is oriented within the enclosure with the major axes of the form being substantially parallel to the width of the bottom wall.

11. The combination of claim 10, wherein the wig or hair piece box further comprises a hanger provided at the end wall with the upper spacer, and wherein the top end of the form is disposed proximate the upper spacer.

12. The combination of claim 10, wherein the wig or hair piece box further comprises a U-shaped retainer, and the lower end of the form is enclosed by the U-shaped retainer.

13. An apparatus for preserving a wig or hair piece, comprising:

a form including a body having an upper end and a lower end, wherein a cross section of the body gradually increases from the upper end to the lower end, and wherein the lower end includes a bottom having a curved shape; and a wig or hair piece comprising:

a strip; and strands of hair having a root end and a tip end, wherein the root end of each strand of hair is attached to the strip, wherein the tip end of each strand of hair includes a curl, wherein the strip is removably attached to the form at or near the upper end of the body, wherein the strands of hair extend down the body from the upper end toward the lower end of the body and the curls extend over the bottom of the body to preserve the curls.

14. The apparatus of claim 13, wherein the curved shape of the bottom is a hemi-spheroid shape.

15. The apparatus of claim 13, wherein the strip is a weft track having a first end and a second end, wherein the first end of the weft track is removably attached to the form at or near the upper end of the body, wherein the weft track is wrapped around the body and the second end of the weft track is removably attached to the form at or near the upper end of the body, wherein the curls of the strands of hair are substantially parallel to each other.

16. The apparatus of claim 13, wherein the cross section of the body is oval with a major axis and a minor axis, the major and minor axes gradually increasing throughout the body from the upper end to the lower end.

17. The apparatus of claim 13, wherein the cross section of the body is circular with a major axis and a minor axis, the major and minor axes being equal and gradually increasing throughout the body from the upper end to the lower end.

18. The apparatus of claim 13, the form further comprising:

a shoulder attached to the upper end of the body.

19. The apparatus of claim 13, wherein the body of the form comprises foamed plastic, polystyrene, polybutadiene, polyethylene, polyurethane, cardboard, or papier-mache.

20. The apparatus of claim 13, wherein the body comprises flexible plastic or rubber, and wherein the body is filled with air or water.

21. The apparatus of claim 13, further comprising:

a hair net covering the wig or hair piece on the form.

22. The apparatus of claim 21, further comprising:

a sleeve covering the hair net and the wig or hair piece on the form.

23. The apparatus of claim 13, further comprising:

a sleeve covering the wig or hair piece on the form.

24. An apparatus for preserving a wig or hair piece, comprising:

a form including a body having an upper end and a lower end, wherein a cross section of the body gradually increases from the upper end to the lower end, and wherein the lower end includes a bottom having a hemispheroid shape; and a wig or hair piece comprising:

a strip; and strands of hair having a root end and a tip end, wherein the root end of each strand of hair is attached to the strip, wherein the tip end of each strand of hair includes a curl, wherein the strip is removably attached to the form at or near the upper end of the body, wherein the strands of hair extend down the body from the upper end toward the lower end of the body and the curls extend over the bottom of the body to preserve the curls; and a wig or hair piece box comprising:

a rectangular enclosure having a bottom wall, two side walls, two end walls, and a hinged front wall, the bottom, front, and side walls of the same length, the bottom and front walls having a greater width than the side walls, one side wall having a slit the front wall having a window, a flap hinged to the front wall, the flap having a tab for insertion into the side wall slot, and an upper spacer at one end wall and a lower spacer at the other end wall.

25. The apparatus of claim 24, wherein the wig or hair piece box further comprises a hanger provided at the end wall with the upper spacer, and wherein a top of the form is disposed proximate the upper spacer.

26. The apparatus of claim 24, wherein the wig or hair piece box further comprises a U-shaped retainer, and the bottom of the form is enclosed by the U-shaped retainer.

* * * * *